US005885760A

United States Patent [19]

Bergthaller et al.

[11] Patent Number: 5,885,760

[45] Date of Patent: Mar. 23, 1999

[54] COLOR PHOTOGRAPHIC RECORDING MATERIAL

[75] Inventors: Peter Bergthaller, Bergisch Gladbach; Jürgen Strobach, Kürten, both of Germany

[73] Assignee: Agfa-Gevaert AG, Germany

[21] Appl. No.: 906,388

[22] Filed: Aug. 5, 1997

[30] Foreign Application Priority Data

Aug. 12, 1996 [DE] Germany ..... 196 32 428.9

[51] Int. Cl.[6] ..... G03C 7/333; G03C 7/34; G03C 7/38

[52] U.S. Cl. ..... 430/505; 430/506; 430/565; 430/549; 430/226

[58] Field of Search ..... 430/504, 506, 430/565, 549, 226

[56] References Cited

U.S. PATENT DOCUMENTS 4,267,264 5/1981 Lohmann et al. ..... 430/505

FOREIGN PATENT DOCUMENTS 27 04 826 8/1978 Germany .

01 161 238 6/1989 Japan .

*Primary Examiner*—Richard L. Schilling
*Assistant Examiner*—Amanda C. Walke
*Attorney, Agent, or Firm*—Connolly & Hutz

[57] ABSTRACT

A color photographic recording material having at least one silver halide emulsion layer unit containing color coupler, which unit comprises at least two adjacent silver halide emulsion partial layers of the spectral sensitivity concerned, one of which is more sensitive and one less sensitive, contains in a reactive association with at least one more sensitive silver halide emulsion partial layer having a comparatively low color coupler content relative to the silver halide content, a compound (or a precursor compound thereof), which is capable under chromogenic development conditions of forming a substantially colorless, diffusible coupling product with the color developer oxidation product, which coupling product is capable under chromogenic development conditions in the presence of an oxidising agent of forming a dye with a color coupler, with transfer of the residue originating from the color developer.

On chromogenic development, color images having improved grain are obtained.

10 Claims, No Drawings

COLOR PHOTOGRAPHIC RECORDING MATERIAL

This invention relates to a colour photographic recording material having at least six silver halide layers sensitised in pairs in the additive primary colours and at least three colour couplers associated with the individual layers in accordance with the complementary colour principle, which material exhibits improved grain.

It is known that the grain measurable in a colour photographic material containing photosensitive silver halide layers and dispersed colour couplers, preferably incorporated in an oil former, after colour development is strongly determined by the reactivity of the colour couplers involved in the formation of the colour image in the individual layers. The reactivity of the colour coupler may be influenced to a certain extent by the selected oil former or dispersant, but it is generally more readily reduced than increased. It is known that grain may be improved to a certain extent in this manner.

It is also known that considerable improvements in colour graininess may be achieved by arranging the couplers and silver halide emulsions using the double layer principle. This is in part related to the resultant flatter gradation, but for the most part to the fact that the concentration ratios of silver halide emulsion and coupler may be adjusted at will. In accordance with the double layer principle, the high sensitivity layers contain relatively little coupler, such that overdevelopment of the more high sensitivity silver halide emulsions used therein is inhibited and only small dye halos may be formed around the individual grains. Accordingly, the high sensitivity layers usually contain a disproportionately high proportion of the silver used in the layers, so that the number of dye clouds formed is sufficiently large to make the necessary contribution to the overall colour density. As is known, the excess colour developer oxidation product is rapidly destroyed by the deamination reaction of the quinonediimine stage. It is primarily the higher redox potential immediately surrounding the developed silver halide grain which inhibits development due to the accumulation of developer oxidation products. The low sensitivity layers in contrast contain such high proportions of coupler that they contribute the majority of the developing colour density.

However, the unconsumed silver halide in the high sensitivity layers is an avoidable burden from both the economic and the photographic viewpoints. It increases the thickness of the layer and light scattering within the layer and reduces the possibility of shortening the diffusion paths between the outer layer and the lowermost photosensitive layers by economising on the layer colloid. It is thus desirable to find processes by means of which good grain may also be achieved at a relatively high coupler/silver ratio.

Various methods have become known in photographic technology by means of which this objective may almost be achieved. All of them, however, have particular disadvantages.

It is known, for example, that the developed grain of layers containing colour coupler is improved by using couplers having limited diffusibility or couplers forming dyes which have limited diffusibility. The proposal known from DE-A-31 35 938, EP-A-0 109 831 and DE-A-35 41 858 involves the use of 2-equivalent couplers which yield an azomethine dye which, after development, initially still has limited diffusibility and becomes incapable of migrating in the layer only once the process is complete. This principle is known to the person skilled in the art under the name "smearing coupler".

The second proposed solution is based on the fact that the developer oxidation product may obviously survive intact for a longer period in a relatively hydrophobic, soft polymer matrix and may even diffuse relatively long distances therein. It may be assumed that the developer oxidation products present in the polymer matrix are not cationic, but instead electronically neutral. The principal deficiency associated with this approach is primarily that layers are more highly loaded, but also that the dye may migrate into the polymer matrix.

It has been found that an improvement in grain may be achieved by incorporating a compound in a reactive association with a high sensitivity silver halide emulsion layer having a comparatively low colour coupler content, which compound is capable under chromogenic development conditions of forming a substantially colourless, diffusible coupling product with the oxidation product of the colour developer used for development (developer oxidation product, DOP), which coupling product is capable under chromogenic development conditions in the presence of an oxidising agent of forming a dye with a colour coupler, with transfer of the residue originating from the colour developer. Due to its ability to transfer the DOP after diffusion over a certain distance onto a colour coupler, the compound could also be described as a DOP transfer agent or DOPTA compound.

Instead of the stated compound, it is also possible to use a suitable precursor compound which is capable of releasing the DOPTA compound under chromogenic development conditions.

The present invention provides a colour photographic recording material having at least one red-sensitive silver halide emulsion layer unit, which is associated with a cyan coupler, at least one green-sensitive silver halide emulsion layer unit, which is associated with a magenta coupler, at least one blue-sensitive silver halide emulsion layer unit, which is associated with a yellow coupler, and optionally further non-photosensitive layers, wherein at least one of the stated silver halide emulsion layer units comprises at least two adjacent silver halide emulsion partial layers of the spectral sensitivity concerned, one of which is more sensitive and one less sensitive, characterised in that the material contains in a reactive association with at least one of said more sensitive silver halide emulsion partial layers that has a comparatively low colour coupler content relative to the silver halide content, a compound (or a precursor compound thereof), which is capable under chromogenic development conditions of forming a substantially colourless, diffusible coupling product with the colour developer oxidation product, which coupling product is capable under chromogenic development conditions in the presence of an oxidising agent of forming a dye with a colour coupler, with transfer of the residue originating from the colour developer.

Within the context of this specification a layer having a relatively low colour coupler content relative to the silver halide content is a layer that contains not more ⅕ of the amount that would be equivalent to the amount of silver halide in that layer.

The DOPTA compounds according to the invention have no more than 18 C atoms and are of the formula I $$\text{COUP—NLG} \qquad \text{(I)}$$

in which

COUP means the residue of a compound (of the formula COUP—H), which is capable under chromogenic development conditions of coupling with the colour developer oxidation product;

NLG (non-leaving group) means a residue attached to the coupling site of COUP which cannot be eliminated under chromogenic development conditions.

The distinguishing feature of the invention is the use of a DOPTA compound of the formula I in a reactive association with a more sensitive silver halide emulsion partial layer having a comparatively low colour coupler content. Should the colour photographic recording materials be those having three-layer silver halide partial layer units, consisting of high, medium and low sensitivity partial layers, the DOPTA compound according to the invention is preferably arranged in a reactive association with a high sensitivity or medium sensitivity silver halide emulsion partial layer. Reactive association should here be taken to mean that the DOPTA compound is arranged relative to the silver halide emulsion partial layer concerned in such a manner that it is capable of reacting with at least a proportion of the DOP produced therein. To this end, the DOPTA compound is located either in the more sensitive silver halide emulsion partial layer itself or in a layer immediately adjacent thereto having a low or zero colour coupler content.

By virtue of the diffusibility of the coupling product formed with the DOP, the DOPTA compound is capable of transferring the image information from the more sensitive silver halide emulsion partial layer having a comparatively low colour coupler content into an adjacent layer containing colour coupler, for example into a less sensitive silver halide emulsion partial layer containing colour coupler of the same silver halide emulsion partial layer unit and thus of contributing to the overall colour density by the transfer of the colour developer residue onto the colour coupler contained therein.

The additions according to the invention may be water soluble, sparingly water soluble or insoluble in water. They may be present as such in the colour photographic recording material or may alternatively be present in the form of an alkali-cleavable precursor compound. After processing, they may be rinsed out of the processed recording material or they may be present in an undiminished proportion in the emulsion droplets or in the binder phase The additions according to the invention are furthermore distinguished in that the coupling products thereof with DOP are substantially colourless.

Suitable DOPTA compounds of the formula I are of one of the formulae II to VIII:

a) compounds of the formula II

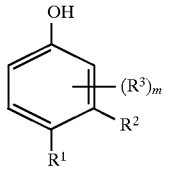

(II)

in which $R^1$ means alkyl, acylamino, or, together with $R^2$, the residue necessary to complete a fused benzene ring;

$R^2$ means H, —OH, alkyl, acylamino or, together with $R^1$ or together with an adjacent $R^3$, the residue necessary to complete a fused benzene ring;

$R^3$ means H, alkyl, acylamino or, if adjacent to $R^1$, —OH or, if adjacent to $R^2$, together with this latter, the residue necessary to complete a fused benzene ring;

m means 0 (zero) or an integer from 1 to 3, wherein two or more residues $R^3$ are identical or different, b) compounds of the formula III

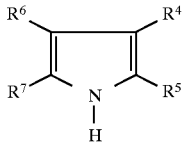

(III)

in which $R^4$ means alkyl, alkoxy, acylamino or, together with $R^5$, the aliphatic residue necessary to complete a fused 5-, 6- or 7-membered carbocyclic ring;

$R^5$ means alkyl, alkoxy, acyl or, together with $R^4$, the aliphatic residue necessary to complete a fused 5-, 6- or 7-membered carbocyclic ring;

$R^6$ means acyl or, together with $R^7$, the residue necessary to complete a fused benzene ring;

$R^7$ means alkyl or, together with $R^6$, the residue necessary to complete a fused benzene ring, c) compounds of one of the formulae IV, V and VI

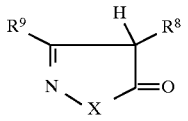

(IV)

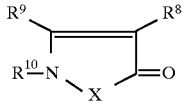

(V)

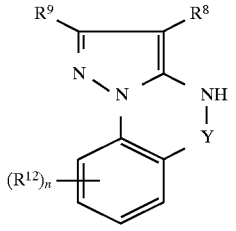

(VI)

in which $R^8$ means alkyl or acylamino or, together with $R^9$, the aliphatic residue necessary to complete a fused 5-, 6- or 7-membered carbocyclic ring (or, only in the formula V: H);

$R^9$ means alkyl, acylamino or, together with $R^8$, the aliphatic residue necessary to complete a fused 5-, 6- or 7-membered carbocyclic ring or, together with $R^{10}$, the residue necessary to complete a fused quinazolinone or 1,1-dioxo-1,2,4-benzothiadiazine ring system;

$R^{10}$ means alkyl or, together with $R^9$, the residue necessary to complete a fused quinazolinone or 1,1-dioxo-1,2,4-benzothiadiazine ring system;

X means —O— or —$NR^{11}$—;

$R^{11}$ means H, alkyl, aryl or sulpholanyl;

Y means —CO—, —$SO_2$— or a single bond;

$R^{12}$ means a substituent;

n means 0 (zero) or an integer from 1 to 4, wherein two or more residues $R^{12}$ are identical or different, d) compounds of one of the formulae VII and VIII

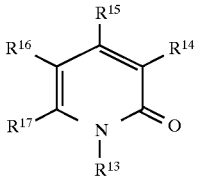

(VII)

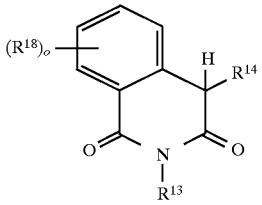

(VIII)

in which $R^{13}$ means alkyl or aryl;

$R^{14}$ means —CN, alkyl or acylamino;

$R^{15}$ and $R^{17}$ mean —OH or alkyl;

$R^{16}$ means alkyl;

$R^{18}$ means a substituent;

o means 0 (zero) or an integer from 1 to 4, wherein two or more residues $R^{18}$ are identical or different.

The entirety of the substituents $R^1$ to $R^{18}$ of the compounds according to the invention contain, depending upon the particular basic structure (formulae II to VIII), no more than 15 C atoms, preferably no more than 12 C atoms and still more preferably no more than 2 to 10 C atoms. The presence of hydrophilic or solubilising groups may be useful in order to achieve the required diffusibility.

Examples of such groups are phenolic hydroxyl groups, carboxyl groups, sulpho groups and N-phenylsulphamoyl groups bearing a further non-substituted H atom on the N atom.

An alkyl group represented by one of the residues $R^1$ to $R^{18}$ preferably contains no more than 4 C atoms. Preferred examples are methyl, ethyl and t.-butyl. The alkyl groups, in particular a methyl group, may also be substituted, for example with carboxyl, sulpho, phenylsulphonyl, hydroximino or phenyl (benzyl).

An alkoxy group ($R^4$, $R^5$) is preferably methoxy or ethoxy.

An acyl group ($R^5$, $R^6$) or an acyl residue of an acylamino group ($R^1$ to $R^4$, $R^8$, $R^9$, $R^{14}$) is derived from an aliphatic or aromatic carboxylic or sulphonic acid, a carbamic acid or a carbonic acid semi-ester. Examples are acetyl, succinoyl, —CO—$CF_3$, methoxycarbonyl, N-methylcarbonyl, benzoyl and phenylsulphonyl.

An aryl group is in particular phenyl, optionally substituted, for example with —OH, alkyl, carboxyl and/or sulpho.

Examples of substituents which are represented by $R^{12}$ or $R^{18}$ are halogen, alkyl, sulphone and sulphonamide.

Suitable examples of DOPTA compounds according to the invention are stated below.

Compound 1

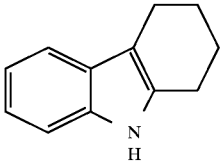

-continued

Compound 2

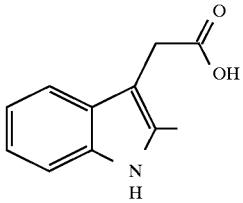

Compound 3

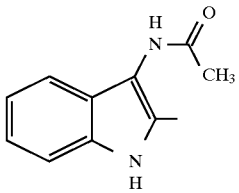

Compound 4

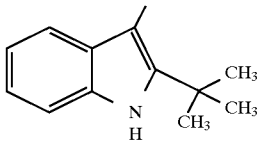

Compound 5

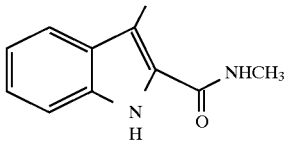

Compound 6

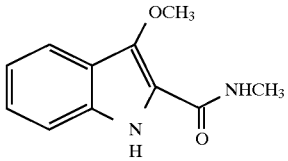

Compound 7

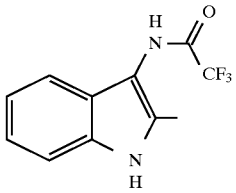

Compound 8

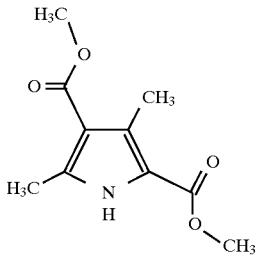

Compound 9

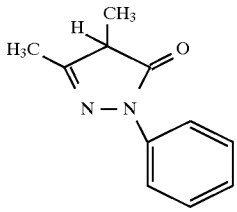

-continued
Compound 10
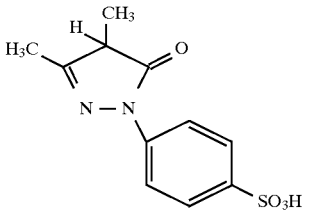
Compound 11
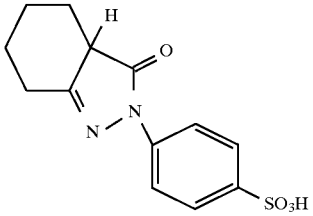
Compound 12
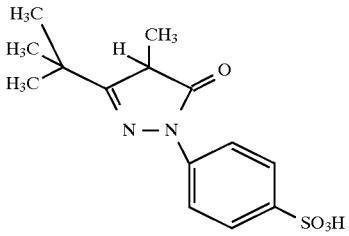
Compound 13
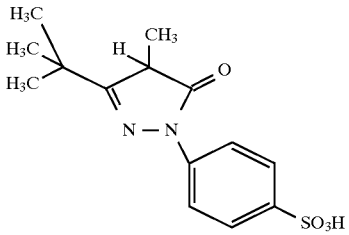
Compound 14
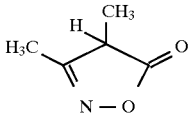
Compound 15
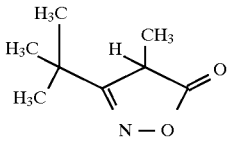
Compound 16
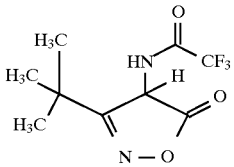
Compound 17
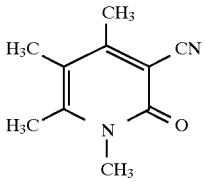
-continued
Compound 18
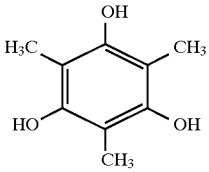
Compound 19
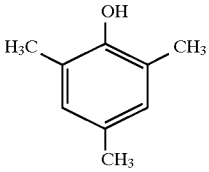
Compound 20
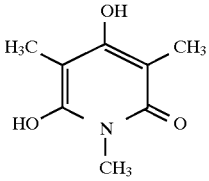
Compound 21
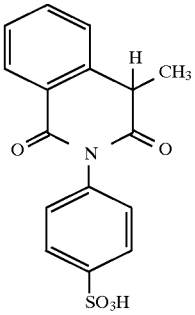
Compound 22
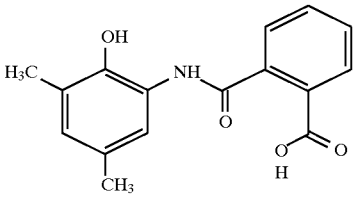
Compound 23
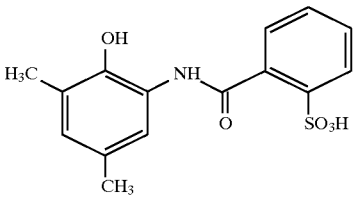
Compound 24
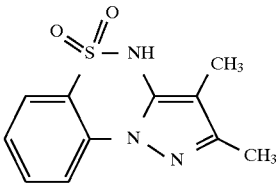
Compound 25
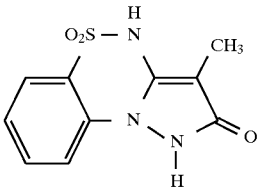

-continued
Compound 26
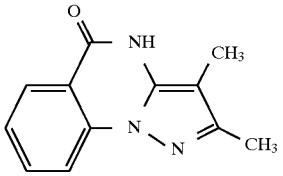
Compound 27
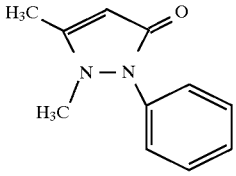
Compound 28
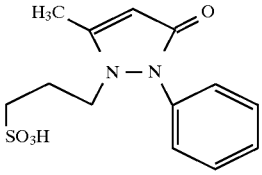
Compound 29
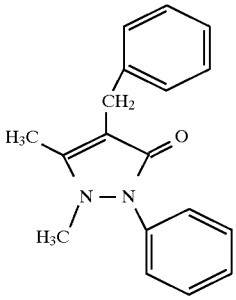
Compound 30
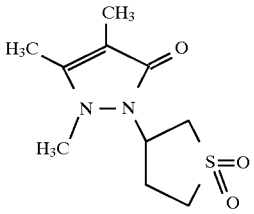
Compound 31
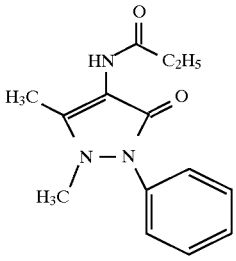
Compound 32
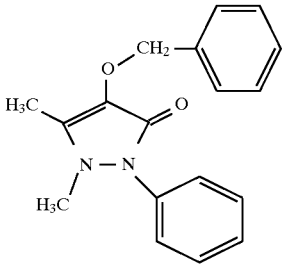
-continued
Compound 33
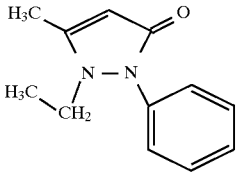
Compound 34
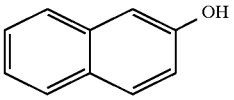
Compound 35
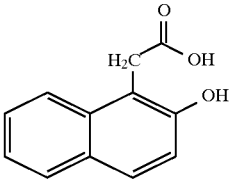
Compound 36
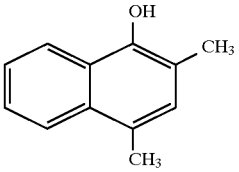
Compound 37
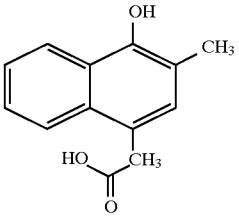
Compound 38
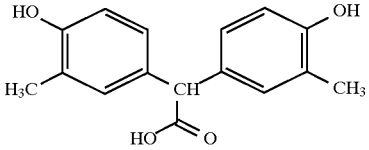
Compound 39
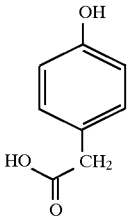
Compound 40
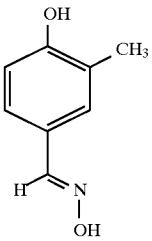

-continued

Compound 41

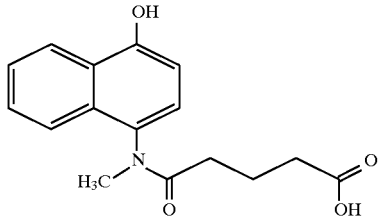

Compound 42

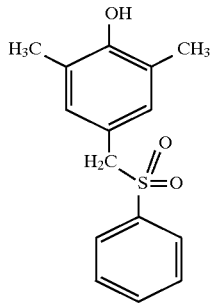

The additions according to the invention are added in the conventional manner to the casting solutions for the particular layer, for example if the compounds concerned have limited or no solubility in water, they are added in emulsified form.

The molar ratio between the DOPTA compound and the concentration of colour coupler present in the layer is conveniently between 1:5 and 5:1; an approximately equimolar ratio is preferred. Relative to the quantity of the colour coupler, the colour density of which is to be increased, the proportion of the DOPTA compound is preferably between 20 mol. % and 200 mol. %.

In a preferred embodiment of the invention, the more sensitive silver halide emulsion partial layer, with which the DOPTA compound according to the invention is associated, contains at most 20% of the equivalent of colour coupler, relative to the quantity of developable silver halide in the more sensitive silver halide emulsion partial layer, while at least 80% of the equivalent of colour coupler is contained in at least one adjacent layer. Such an adjacent layer may be a non-photosensitive layer or a less sensitive silver halide emulsion partial layer.

Examples of recording materials according to the invention are in particular colour photographic colour negative films and colour reversal films.

The photographic materials consist of a support onto which the photosensitive silver halide emulsion layers are applied. Thin films and sheets are in particular suitable as supports. A review of support materials and the auxiliary layers applied to the front and reverse sides of which is given in *Research Disclosure* 37254, part 1 (1995), page 285.

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally arranged between the green-sensitive and blue-sensitive layers so preventing blue light from reaching the underlying layers.

Possible options for different layer arrangements and the effects thereof on photographic properties are described in *J. Inf. Rec. Mats.,* 1994, volume 22, pages 183–193.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride.

Details relating to colour couplers may be found in *Research Disclosure* 37254. part 4 (1995), page 288 and in Research Disclosure 37038, part 11 (1995), page 80. The maximum absorption of the dyes formed from the couplers and the developer oxidation product is preferably within the following ranges: yellows coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254. part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, antioxidants, $D_{min}$ dyes, additives to improve stabilisation of dyes, couplers and whites and to reduce colour fogging, plasticisers (latices), biocides and others.

Suitable compounds may be found in Research Disclosure 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in Research Disclosure 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLES

Example 1

The mode of action of the DOPTA compounds according to the invention is demonstrated in the layer structures described in Example 1.

Material 1 (comparison)

A three-layer test structure (magenta casting) of a colour photographic recording material for colour negative development was produced by applying the following layers in the stated sequence onto a transparent cellulose triacetate film base of a thickness of 120 $\mu$m provided with an adhesion layer. Quantities are stated in g/m$^2$. The silver halide application rate is stated as the corresponding quantities of $AgNO_3$.

| | | |
|---|---|---|
| Layer 1: | Green-sensitised silver bromide emulsion | 1.1 |
| | Gelatine | 2.1 |
| | Magenta coupler XM-1 | 0.85 |
| | Tricresyl phosphate (TCP) | 0.85 |
| Layer 2: | Gelatine | 0.5 |
| Layer 3: | Gelatine | 0.5 |
| | Instant hardener XH-1 | 0.035 |

Compounds used in material 1:

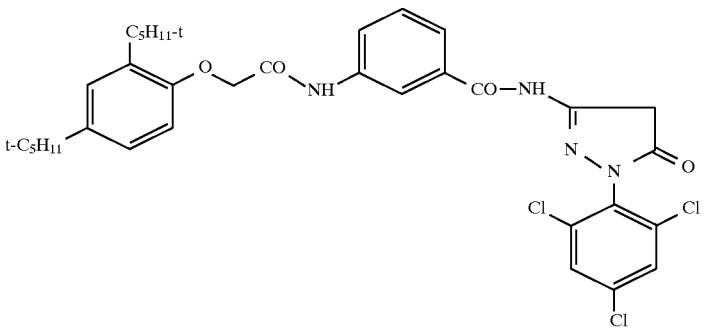

XM-1

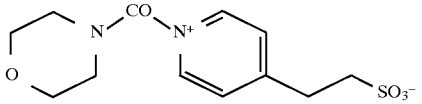

XH-1

Material 2 (Comparison)

A four-layer test structure (magenta casting) containing the following layers was produced:

| | | |
|---|---|---|
| Layer 1: | Gelatine | 1.7 |
| | Magenta coupler XM-1 | 0.85 |
| | Tricresyl phosphate (TCP) | 0.85 |

-continued

| | | |
|---|---|---|
| Layer 2: | Medium sensitivity, green-sensitised silver bromide emulsion | 1.1 |
| | Gelatine | 0.85 |
| Layer 3: | Gelatine | 0.5 |
| Layer 4: | Gelatine | 0.5 |
| | Instant hardener XH- 1 | 0.045 |

Material 3.1 (Comparison)

A five-layer test structure (magenta casting) containing the following layers was produced:

| | | |
|---|---|---|
| Layer 1: | Gelatine | 1.7 |
| | Magenta coupler XM-1 | 0.85 |
| | Tricresyl phosphate (TCP) | 0.85 |
| Layer 2: | Gelatine | 1.0 |
| Layer 3: | Medium sensitivity, green-sensitised silver bromide emulsion | 1.1 |
| | Gelatine | 0.85 |
| Layer 4: | Gelatine | 0.5 |
| Layer 5: | Gelatine | 0.5 |
| | Instant hardener XH-1 | 0.045 |

Materials 3.2 to 3.26

In a similar manner to material 3.1, five-layer test structures (magenta coating) containing the following layers were produced, wherein a DOPTA compound according to the invention was used in layer 2, as may be seen from Table 1:

| | | |
|---|---|---|
| Layer 1: | Gelatine | 1.65 |
| | Magenta coupler XM-1 | 0.83 |
| | Tricresyl phosphate (TCP) | 0.83 |
| Layer 2: | Gelatine | 1.0 |
| | Addition according to the invention (DOPTA compound) | (1 mmol) |
| | Dibutyl phthalate (DBP) | 0.4 |
| Layer 3: | Medium sensitivity, green-sensitised silver bromide emulsion | 1.1 |
| | Gelatine | 0.85 |

-continued

| | | |
|---|---|---|
| Layer 4: | Gelatine | 0.5 |
| Layer 5: | Gelatine | 0.5 |
| | Instant hardener XH-1 | 0.040 |

Materials 1, 2 and 3.1 to 3.26 were exposed through a graduated grey wedge and subjected to the Flexicolor C41 colour negative process (*The British Journal of Photography,* 1974, 597).

Evaluation was performed in the maximum densities, which were compared and assessed for grain (Table 1).

TABLE 1

| Material | Compound | Density behind green filter | Grain $\sigma_D$ value | |
|---|---|---|---|---|
| 1 | — | 2.80 | 7.9 | Comparison |
| 2 | — | 0.87 | 2.5 | Comparison |
| 3.1 | — | 0.21 | not measurable | Comparison |
| 3.2 | 1 | 0.43 | not measurable | Invention |
| 3.3 | 2 | 0.46 | not measurable | Invention |
| 3.4 | 5 | 0.35 | not measurable | Invention |
| 3.5 | 7 | 0.38 | not measurable | Invention |
| 3.6 | 10 | 0.46 | not measurable | Invention |
| 3.7 | 11 | 0.44 | not measurable | Invention |
| 3.8 | 12 | 0.42 | not measurable | Invention |
| 3.9 | 16 | 0.39 | not measurable | Invention |
| 3.10 | 17 | 0.40 | not measurable | Invention |
| 3.11 | 18 | 0.40 | not measurable | Invention |
| 3.12 | 19 | 0.36 | not measurable | Invention |
| 3.13 | 21 | 0.45 | not measurable | Invention |
| 3.14 | 22 | 0.42 | not measurable | Invention |
| 3.15 | 24 | 0.33 | not measurable | Invention |
| 3.16 | 27 | 0.33 | not measurable | Comparison |
| 3.17 | 28 | 0.30 | not measurable | Invention |
| 3.18 | 30 | 0.33 | not measurable | Invention |
| 3.19 | 33 | 0.30 | not measurable | Invention |
| 3.20 | 34 | 0.34 | not measurable | Invention |
| 3.21 | 35 | 0.39 | not measurable | Invention |
| 3.22 | 37 | 0.40 | not measurable | Invention |
| 3.23 | 38 | 0.44 | not measurable | Invention |
| 3.24 | 39 | 0.39 | not measurable | Invention |
| 3.25 | 40 | 0.35 | not measurable | Invention |
| 3.26 | 42 | 0.40 | not measurable | Invention |

In all the Examples, hardening was adjusted in such a manner that a swelling factor of 3 was achieved. The thickness of the interlayer in the swollen state is then approx. 3.2 $\mu$m. The density achieved in material 3.1 arises solely by the transfer of developer oxidation product via the interlayer. This yields a grainless image.

It has been found that, as expected, the density arising in materials 3.2 to 3.26 by virtue of the extension of the range of the developer oxidation product results in a grainless image, the contribution made by this density to overall colour density is increased by the compounds according to the invention and consequently, due to the reduction in silver application rate in an adjacent low sensitivity layer, may contribute towards a reduction in overall grain.

Example 2

A four-layer magenta casting of a colour photographic recording material for colour negative development was produced (material 2.1, Comparison), by applying the following layers in the stated sequence onto a transparent cellulose triacetate film base of a thickness of 120 $\mu$m provided with an adhesion layer. Quantities are stated in g/m$^2$. The silver halide application rate is stated as the corresponding quantities of $AgNO_3$. The silver halide emulsions were stabilised with 0.1 g of 4-hydroxy-6-methyl-1,3,3a,7-tetraazaindene per 100 g of $AgNO_3$. The silver halide emulsions are characterised by their halide composition and, with regard to grain size, by the volume-weighted average particle diameter $d_{\bar{v}}$, which is calculated in accordance with the formula $$d_{\bar{v}} = \frac{\Sigma n_i \cdot d_i^4}{\Sigma n_i \cdot d_i^3}$$

wherein $n_i$ means the number of particles in the range i and $d_i$ means the diameter of spheres of an identical volume for the particles in the range i. $d_{\bar{v}}$ is stated below in $\mu$m.

Material 2.1 (Comparison)

| | | |
|---|---|---|
| Layer 1: | (Low sensitivity, green-sensitised layer) | |
| | Green-sensitised silver bromide-iodide emulsion (9 mol. % iodide; $d_{\bar{v}}$ = 0.42) | 0.72 |
| | Gelatine | 1.20 |
| | Magenta coupler XM-1 | 0.50 |
| | TCP | 0.50 |
| Layer 2: | (Medium sensitivity, green-sensitised layer) | |
| | Green-sensitised silver bromide-iodide emulsion (5.0 mol. % iodide $d_{\bar{v}}$ = 0.60) | 1.20 |
| | Gelatine | 1.00 |
| | Magenta coupler XM-1 | 0.25 |
| | TCP | 0.22 |
| Layer 3: | (High sensitivity, green-sensitised layer) | |
| | Green-sensitised silver bromide-odide emulsion with tabular crystals (6.0 mol. % iodide; $d_{\bar{v}}$ = 1.1) | 1.55 |
| | Gelatine | 1.00 |
| | Magenta coupler XM-1 | 0.08 |
| | TCP | 0.10 |
| Layer 4: | (Yellow filter layer) | |
| | Gelatine | 1.20 |
| | Yellow filter dye XF-1 | 0.07 |
| | Instant hardener XH-1 | 0.045 |

Compounds used in material 2.1:

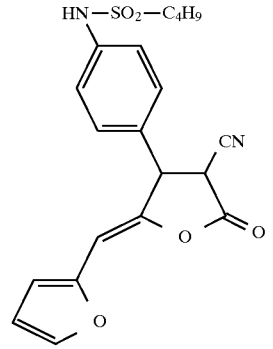

XF-1

Material 2.2 (According to the invention)

A four-layer test structure (magenta casting) containing the following layers was produced:

| | | |
|---|---|---|
| Layer 1: | (Low sensitivity, green-sensitised layer) | |
| | Green-sensitised silver bromide-iodide emulsion (9 mol. % iodide; $d_{\bar{v}}$ = 0.42) | 0.72 |
| | Gelatine | 1.20 |
| | Magenta coupler XM-1 | 0.50 |
| | TCP | 0.65 |
| Layer 2: | (Medium sensitivity, green-sensitised layer) | |
| | Green-sensitised silver bromide-iodide emulsion (5.0 mol. % iodide; $d_{\bar{v}\ dV}$ = 0.60) | 1.20 |
| | Gelatine | 0.7 |
| | Compound 2 according to the invention | 0.17 |
| | Compound 9 according to the invention | 0.25 |
| | DBP | 0.22 |

-continued

| | | |
|---|---|---|
| Layer 3: | (High sensitivity, green-sensitised layer) | |
| | Green-sensitised silver bromide-iodide emulsion with tabular crystals (6.0 mol. % iodide; $d_{\bar{V}\ V}$= 1.1) | 1.55 |
| | Gelatine | 1.00 |
| | Magenta coupler XM-1 | 0.2 |
| | TCP | 0.1 |
| Layer 4: | (Yellow filter layer) | |
| | Gelatine | 1.20 |
| | Yellow filter dye XF-1 | 0.07 |
| | Instant hardener XH-1 | 0.045 |

Immediately after casting, the described materials were further processed as in Example 1. Sensitivity was determined by densitometric measurement behind a green filter (magenta) at density 0.2 and 1.0 (relative DIN units). Grain was determined at density 0.4 and 1.0 ($\sigma_D$ values). The results are shown in Table 2.

TABLE 2

| Material | Sensitivity | $\gamma_1$ | $\gamma_2$ | $\sigma_{D(0.4)}$ | $\sigma_{D(1.0)}$ |
|---|---|---|---|---|---|
| 2.1 | 35.8 | 0.5 | 0.8 | 9.0 | 10.1 |
| 2.2 | 35.9 | 0.45 | 0.7 | 8.75 | 9.5 |

We claim:

1. A color photographic recording material which comprises at least one red-sensitive silver halide emulsion layer unit, which is associated with a cyan coupler, at least one green-sensitive silver halide emulsion layer unit, which is associated with a magenta coupler, at least one blue-sensitive silver halide emulsion layer unit, which is associated with a yellow coupler, and optionally further non-photosensitive layers, wherein at least one of the stated silver halide emulsion layer units comprises at least two adjacent silver halide emulsion partial layers of the spectral sensitivity concerned, one of which is more sensitive and one less sensitive, wherein the material contains in a reactive association with at least one of said more sensitive silver halide emulsion partial layers that has a comparatively low color coupler content relative to the silver halide content, a compound (or a precursor compound thereof), which is capable under chromogenic development conditions of forming a substantially colorless, diffusible coupling product with the color developer oxidation product, which coupling product is capable under chromogenic development conditions in the presence of an oxidizing agent of forming a dye with a coupler, with transfer of the residue originating from the color developer.

2. The recording material according to claim 1, wherein the compound which is capable under chromogenic development conditions of forming a substantially colorless diffusible coupling product with the color developer oxidation product, which coupling product is capable under chromogenic development conditions in the presence of an oxidizing agent of forming a dye with a color coupler, with transfer of the residue originating from the color developer, has no more than 18 C atoms and is of the formula I

COUP—NLG (I)

in which

COUP is the residue of a compound (of the formula COUP—H), which is capable under chromogenic development conditions of coupling with the color developer oxidation product;

NLG (non-leaving group) is a residue attached to the coupling site of COUP which cannot be eliminated under chromogenic development conditions.

3. The recording material according to claim 2, wherein the compound of the formula I is selected from the group consisting of a), b), c) and d)

a) compounds of the formula II

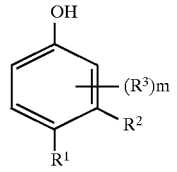

(II)

in which $R^1$ is alkyl, acylamino, or, together with $R^2$, the residue necessary to complete a fused benzene ring;

$R^2$ is H, —OH, alkyl, acylamino or, together with $R^1$ or together with an adjacent $R^3$, the residue necessary to complete a fused benzene ring;

$R^3$ is H, alkyl, acylamino or, if adjacent to $R^1$, —OH or, if adjacent to $R^2$, together with $R^2$, the residue necessary to complete a fused benzene ring;

m is 0 (zero) or an integer from 1 to 3, wherein two or more residues $R^3$ are identical or different, b) compounds of the formula III

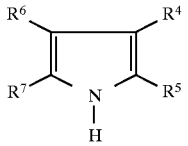

(III)

in which $R^4$ is alkyl, alkoxy, acylamino or, together with $R^5$, the aliphatic residue necessary to complete a fused 5-, 6- or 7-membered carbocyclic ring;

$R^5$ is alkyl, alkoxy, acyl or, together with $R^4$, the aliphatic residue necessary to complete a fused 5-, 6- or 7-membered carbocyclic ring;

$R^6$ is acyl or, together with $R^7$, the residue necessary to complete a fused benzene ring;

$R^7$ is alkyl or, together with $R^6$, the residue necessary to complete a fused benzene ring, c) compounds of one of the formulae IV, V or VI

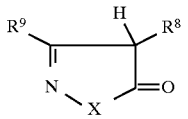

(IV)

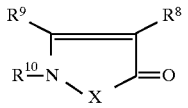

(V)

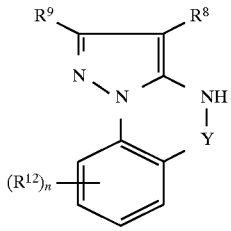

(VI)

in which $R^8$ is alkyl or acylamino or, together with $R^9$, the aliphatic residue necessary to complete a fused 5-, 6- or 7-membered carbocyclic ring (or, only in the formula V:H);

$R^9$ is alkyl, acylamino or, together with $R^8$, the aliphatic residue necessary to complete a fused 5-, 6- or 7-membered carbocyclic ring or, together with $R^{10}$, the residue necessary to complete a fused quinazolinone or 1,1-dioxo-1,2,4-benzothiadiazine ring system;

$R^{10}$ is alkyl or, together with $R^9$, the residue necessary to complete a fused quinazolinone or 1,1-dioxo-1,2,4-benzothiadiazine ring system;

X is —O— or $NR^{11}$—;

$R^{11}$ is H, alkyl, aryl or sulpholanyl;

Y is —CO—, $SO_2$— or a single bond;

$R^{12}$ is a substitutent;

n is 0 (zero) or an integer from 1 to 4, wherein two or more residues $R^{12}$ are identical or different, d) compounds of one of the formulae VII or VIII

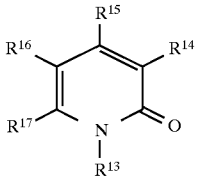

(VII)

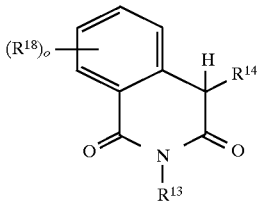

(VIII)

in which $R^{13}$ is alkyl or aryl;

$R^{14}$ is —CN, alkyl or acylamino;

$R^{15}$ and $R^{17}$ are identical or different and are —OH or alkyl;

$R^{16}$ is alkyl;

$R^{18}$ is a substituent;

o means 0 (zero) or an integer from 1 to 4, wherein two or more residues $R^{18}$ are identical or different.

4. The recording material according to claim 1, wherein the more sensitive silver halide emulsion partial layer contains at most 20% of the equivalent of color coupler, while at least 80% of the equivalent of color coupler are contained in at lest one adjacent layer.

5. The recording material according to claim 3, wherein the compound of formula I is a compound of the formula II.

6. The recording material according to claim 3, wherein the compound of formula I is a compound of the formula III.

7. The recording material according to claim 3, wherein the compound of formula I is at least one compound of formula VI, V, or IV.

8. The recording material according to claim 3, wherein the compound of formula I is at least one compound of the formula VII or VIII.

9. The recording material according to claim 7, wherein said compound of formula I is a compound of formula VI and $R^{12}$ is halogen, alkyl, sulphone or sulphonamide.

10. The recording material according to claim 8, wherein said compound of formula I is a compound of formula VIII and $R^{18}$ is halogen, alkyl, sulphone or sulphanoamide.

* * * * *